United States Patent [19]

Renwick et al.

[11] Patent Number: 4,784,349

[45] Date of Patent: Nov. 15, 1988

[54] YARN CREEL APPARATUS

[75] Inventors: Kimberly J. Renwick, Huntersville, N.C.; William E. A. Shelton, Leicestershire, England

[73] Assignee: Alan Shelton Limited, Croft, England

[21] Appl. No.: 100,987

[22] Filed: Sep. 25, 1987

[30] Foreign Application Priority Data

Sep. 27, 1986 [GB] United Kingdom ..... 8623308

[51] Int. Cl.[4] ..... B65H 49/14

[52] U.S. Cl. ..... 242/131; 15/301; 57/304; 242/131.1

[58] Field of Search ..... 242/131, 131.1, 35.5 R; 57/304, 305; 15/301; 28/190

[56] References Cited

U.S. PATENT DOCUMENTS

| | | | |
|---|---|---|---|
| 2,120,888 | 6/1938 | Eaddy | 242/131.1 |
| 2,140,420 | 12/1938 | Eaddy | 15/301 X |
| 2,147,190 | 2/1939 | Cadden | 15/301 |
| 3,311,135 | 3/1967 | Maguire, Jr. et al. | 15/301 X |
| 3,378,998 | 4/1968 | Shackelford | 15/301 |
| 3,391,528 | 7/1968 | Shackelford | 15/301 X |
| 3,412,545 | 11/1968 | Lippuner | 15/301 X |
| 3,667,093 | 6/1972 | Culpepper,Jr. | 242/131.1 X |
| 3,875,883 | 4/1975 | Eberwein et al. | 242/131.1 X |
| 4,572,458 | 2/1986 | Bluhm et al. | 242/131 |

FOREIGN PATENT DOCUMENTS

| | | | |
|---|---|---|---|
| 3429153 | 2/1985 | Fed. Rep. of Germany | 242/131 |
| 983388 | 2/1965 | United Kingdom . | |
| 1370915 | 10/1974 | United Kingdom | 242/131 |

*Primary Examiner*—Stanley N. Gilreath

*Attorney, Agent, or Firm*—Spensley Horn Jubas & Lubitz

[57] ABSTRACT

The invention provides a yarn creel apparatus for the control of loose fly or lint formed when yarn is drawn from packages or cones (12) for use in a textile machine. The apparatus comprises a casing (10) within which the cones (12) are arranged on bobbin pins (11), air conduction means in the form of fans (17) to draw air into the casing from the surrounding atmosphere through at least one inlet comprising a filter panel (15) and then generally downwardly over the yarn cones to at least one outlet comprising filter panel(s) (16). The casing also houses yarn guide tubes (14) to guide yarn from the cones (12) upwardly within the casing tubes continuing through the casing wall to lead the yarns away from the apparatus. A self-cleaning version of the apparatus is also disclosed in which the filter panels (15,16) are replaced by an endless band of filter material (18) which is driven by rollers (21) past suction cleaning heads (22,23).

8 Claims, 2 Drawing Sheets

YARN CREEL APPARATUS

Figure 1:
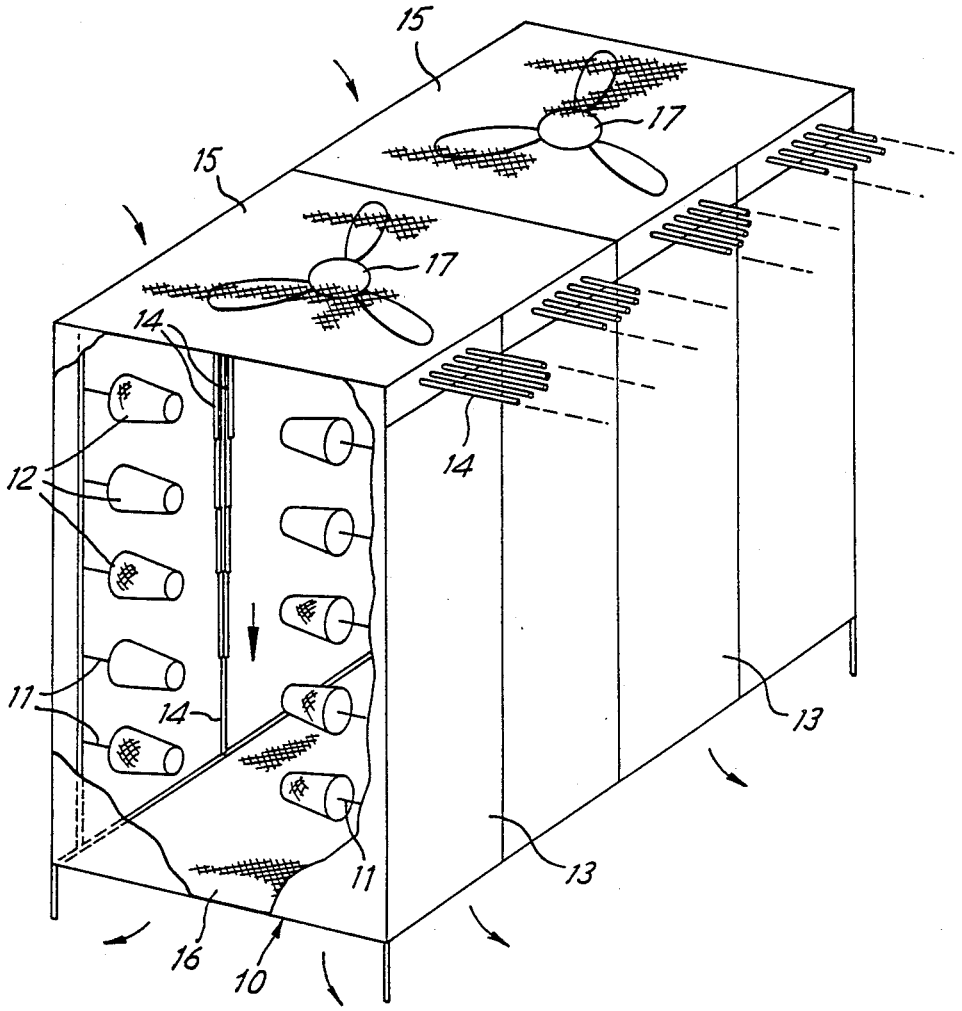

The invention is concerned with improvements in or relating to the handling of textile yarn, particularly to apparatus for the control of loose fly or lint released by yarns during travel between stations in a textile manufacturing process. During the processing of spun yarns, debris such as short hairs, fibres and dust (hereinafter referred to as "fly or lint") is generated which can contaminate the working environment and cause problems by settling on yarn cones, machines, fabric, etc. The emission of lint or fly occurs particularly where the yarns are drawn off the yarn cones. To overcome this problem, yarn creels have been designed which are contained in a casing and which incorporate a system for circulating the air within the casing interior, this system including a filter to separate out the debris. However, debris is also present in the working environment outside the casing, and this is normally drawn into the casing as well.

According to the present invention, there is provided a yarn creel apparatus for the control of loose fly or lint comprising a casing within which yarn packages are contained in use, air conduction means to draw air into the casing from the surrounding atmosphere through at least one inlet and to expel air from the casing to the surrounding atmosphere through at least one outlet, first filter means provided at the or each inlet to filter out debris from the air being drawn into the casing, and second filter means provided at the or each outlet to filter out debris from the air being expelled from the casing.

The air conduction means may comprise at least one fan, preferably positioned adjacent to the or each inlet.

Advantageously, the first filter means and the second filter means may be formed from an endless band of filter material adapted to surround the casing to as to cover the inlets and the outlets, there being provided at least one driven roller device supporting said band to drive the filter material in a path surrounding the casing so that sequential portions of the band are successively presented to the inlet to comprise said first filter means.

Preferably, the apparatus is provided with suction means acting upon sequential portions of the band as it is driven in said path to clean accumulated lint and fly therefrom.

Advantageously, the or each inlet is located in an upper part of the casing, and the or each outlet is located in a lower part thereof so that there is a generally downward movement of air through the interior of the casing. In an example of the invention, the outlet is positioned in the floor of the casing.

There will now be described with reference to the drawings, two examples of apparatus according to the invention. It will be understood that the description is given by way of example only and not by way of limitation.

Figure 2:
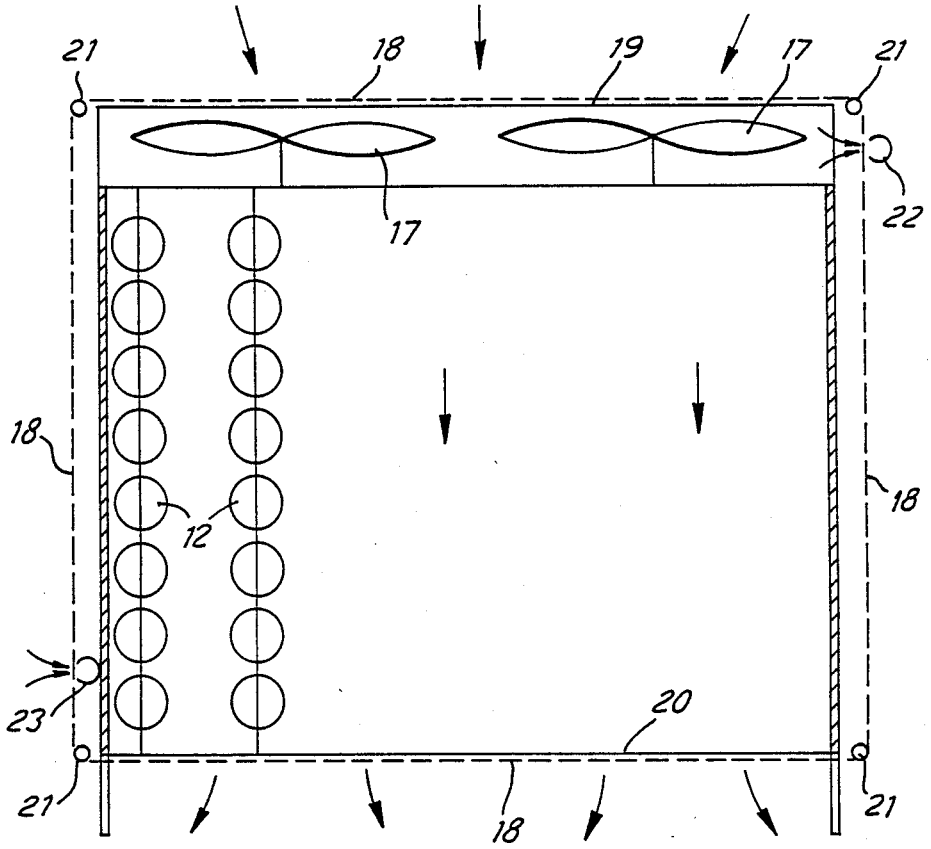

In the drawings:

FIG. 1 is a schematic perspective view of a first example of a creel apparatus according to the invention; and FIG. 2 is schematic side view in section of a second example.

The yarn creel of FIG. 1 comprises a casing 10 in which are disposed framework members supporting bobbin pins 11 for receiving yarn cones 12 thereon. There are two ranks of cones arranged in a generally vertical layout. Side walls of the casing contain doors 13 which can be opened to allow the yarn cones to be mounted on and removed from the pins 11, one such door being provided for each batch of bobbin pins.

To guide the yarns from the yarn cones 12 to the exterior of the casing (from where they are passed e.g. to a knitting machine), a series of tubes 14 are provided. Each of these tubes 14 extends from a point adjacent to the respective yarn cone upwardly between the ranks of cones 12 and then transversely below a top wall of the casing to leave the casing through the upper part of one of the aforesaid side walls.

The above mentioned top wall of the casing 10 is composed of filter panels 15 which provide first filter means at inlets to allow air to enter the interior of the casing from the surrounding atmosphere. Further filter panels 16 are disposed in the floor of the casing 10, and provide second filter means at outlets through which air can pass from the interior of the casing back to the surrounding atmosphere. To maintain air circulation through the interior of the casing 10, fans 17 are mounted directly beneath the filter panels 15.

In operation, the action of the fans 17 causes a generally downward movement of air through the casing which, together with the action of gravity, drives any debris towards the lower part of the casing where it is collected on the filter panels 16. At the same time, the action of the fans 17 drawing in air through the filter panels 15 causes debris floating in the surroundings to become deposited on those panels. In this way, the aforementioned contamination caused by lint and fly is considerably reduced, both within the yarn creel itself and in the surrounding atmosphere.

To facilitate removal of the filtered debris, the filter panels 15 and 16 are arranged so that they can be brought into a suitable position for cleaning. For example, the panels 15 can be arranged so that they can slide away from the direction in which the tubes 14 emerge from the casing and then be pivotted downwardly, whilst the panels 16 can simply be slidable or pivotable to enable access to be gained to the surface on which the debris has become deposited.

The second example, shown in FIG. 2, also comprises a casing, enclosing yarn bobbin 12 as before. However, the static filter means 15 and 16 of the first example are here replaced by a continuous band of filter material 18 surrounding the casing on four sides 20 so as to cover the top wall inlet 19 and the bottom floor outlet 20. At each corner of the casing is provided a roller 21, at least one of which is driven by a motor (not shown). Air passing through a portion of the band 18 at the inlet 19 deposits lint on the outer surface of the band 18 and air passing through an opposite portion of the band 18 at the outlet deposits lint on the inner surface of the band 18. Suction means 22 are provided along the path of the driven band to remove the lint from the outer surface of the band and suction means 23 to remove the lint from the inner surface.

We claim:

1. Yarn creel apparatus for the control of loose fly or lint comprising a casing within which yarn packages are contained in use, said casing having at least one inlet and at least one outlet defined therein, air conduction means to draw air into the casing from the surrounding atmosphere through the at least one inlet and to expel air from the casing to the surrounding atmosphere through the at least one outlet, first filter means provided in the at least one inlet to filter out debris from the air being drawn into the casing, and second filter means provided in the at least one outlet to filter out debris from the air being expelled from the casing.

2. Apparatus as claimed in claim 1 wherein the casing has an upper part and a lower part and wherein the at least one inlet is provided n the upper part of the casing the at least one outlet is provided in the lower part of the casing.

3. Apparatus as claimed in claim 1 wherein the casing has a top wall and a lowermost part and wherein the at least one inlet is provided in the top wall of the casing and the at least one outlet is provided in the lowermost part of the casing.

4. Apparatus as claimed in claim 1 wherein the air conduction means comprise at least one fan arranged to cause a generally downward flow of air through the casing.

5. Apparatus as claimed in claim 4 wherein the fan is situated at the upper part of the casing adjacent the at least one inlet.

6. Apparatus as claimed in claim 1 further comprising guide tubes arranged to lead yarns drawn from the yarn packages in a path upwardly through the casing interior so that the yarns leave the casing through an upper part of the casing.

7. Apparatus as claimed in claim 1, wherein the first filter means and the second filter means are formed from an endless band of filter material adapted to surrounding the casing so as to cover the at least one inlet and the at least one outlet, and further comprising at least one driven roller device for supporting and driving said band of filter material in a path surrounding the casing, whereby sequential portions of the band are successively presented to the at least one inlet.

8. Apparatus as claimed in claim 7, further comprising suction means for acting upon sequential portions of the band as the band is driven in said path to thereby clean accumulated lint and fly from the band.

* * * * *